US005402161A

United States Patent [19]

Kimura et al.

[11] Patent Number: 5,402,161

[45] Date of Patent: Mar. 28, 1995

[54] SERIAL RECORDING APPARATUS

[75] Inventors: Tetsuo Kimura, Sagamihara; Takashi Saito; Shigeru Yoshimura, both of Yokohama, all of Japan

[73] Assignee: Canon Kabushiki Kaisha, Tokyo, Japan

[21] Appl. No.: 735,761

[22] Filed: Jul. 29, 1991

Related U.S. Application Data

[63] Continuation of Ser. No. 381,368, Jul. 18, 1989, abandoned.

[30] Foreign Application Priority Data

Jul. 21, 1988 [JP] Japan ..... 63-182067
Jul. 21, 1988 [JP] Japan ..... 63-182068
Jul. 21, 1988 [JP] Japan ..... 63-182069

[51] Int. Cl.[6] ..... B41J 23/00

[52] U.S. Cl. ..... 347/37; 347/20; 347/39

[58] Field of Search ..... 346/76 PH; 347/37, 39, 347/49, 20, 56, 57, 70; 310/323, 328

[56] References Cited

U.S. PATENT DOCUMENTS 4,044,881 8/1977 Chai et al. ..... 197/82
4,404,572 9/1983 Okumura et al. ..... 347/37
4,672,256 6/1987 Okuno et al. ..... 310/323
4,709,248 11/1987 Piatt et al. ..... 347/49 X
4,786,836 11/1988 Tokushima ..... 310/323
4,947,188 8/1990 Nozaki ..... 346/76 PH

FOREIGN PATENT DOCUMENTS 61-57365 3/1986 Japan .
62-077968 10/1987 Japan .
62-077969 10/1987 Japan .

*Primary Examiner*—A. T. Grimley
*Assistant Examiner*—Sandra L. Brasé
*Attorney, Agent, or Firm*—Fitzpatrick, Cella, Harper & Scinto

[57] ABSTRACT

In a serial recording apparatus wherein a recording head is carried on a carriage movable in the direction of a print column and the recording head is driven on the basis of printing data while scanning by the recording head, to thereby form a dot image on a sheet, piezoelectric elements are joined to a vibration plate provided on the underside of the carriage and the vibration plate is slidably urged against the surface of a fixed member by a resilient force to thereby constitute a travelling wave type ultrasonic motor. A travelling wave is generated in the vibration plate by the piezoelectric elements being driven to thereby control the movement of the carriage.

10 Claims, 12 Drawing Sheets

SERIAL RECORDING APPARATUS

This application is a continuation of application Ser. No. 07/381,368, filed Jul. 18, 1989, now abandoned.

BACKGROUND OF THE INVENTION

1. Field of the Invention

This invention relates to a serial recording apparatus for forming dot images on a sheet on the basis of print data while scanning in the direction of a print column by a recording head carried on a carriage.

2. Related Background Art

As a recording apparatus for a printer, a facsimile apparatus or the like, use has widely been made of a recording apparatus of the type in which a recording head is carried on a carriage movable in the direction of the print column and the recording head is driven on the basis of print data while scanning by the recording head, thereby forming dot images on a sheet, i.e., a serial recording apparatus.

FIGS. 12 to 15 of the accompanying drawings are fragmentary perspective views showing the essential portions of the various types of the driving mechanism for said carriage.

FIG. 12 shows a carriage driving mechanism of the rack-and-pinion type.

In FIG. 12, a carriage 62 carrying a recording head 61 thereon is supported for movement along a guide shaft 63 and a guide rail 64. A pinion 65 rotated by a carriage motor (not shown) is supported on the carriage 62 and is in meshing engagement with an elongated rack 66 installed on the basis of a recording apparatus, and the position and movement of the carriage 62 can be controlled by controlling the rotation of the pinion 65 by the carriage motor. A rotary encoder 67 for detecting the rotation of the pinion 65 is mounted on the carriage 62.

FIG. 13 shows a carriage driving mechanism of the belt transmission type.

In FIG. 13, a carriage 72 carrying a recording head 71 thereon is connected to a belt 75 passed over a pair of pulleys 73 and 74. One pulley 73 is a driving pulley rotatively driven by a carriage motor 76, and the other pulley 74 is a follower pulley.

Accordingly, the movement and position of the carriage 72 can be controlled by controlling the revolution of the motor 76.

FIG. 14 shows a carriage driving mechanism of the wire rope type.

In FIG. 14, a carriage 82 carrying a recording head 81 thereon is driven by a carriage motor 83 through a wire rope 84.

The opposite ends of the wire rope 84 are connected to the carriage 82, and the wire rope 84 is passed over four guide pulleys 85A, 85B, 85C and 85D and the movement and position thereof are controlled by a driving pulley 86 rotated by the motor 83.

FIG. 15 shows a carriage driving mechanism of the lead screw type.

In FIG. 15, a carriage 92 carrying a recording head 91 thereon is threadably engaged with a threaded bar 93, which is rotatively driven by a carriage motor 94 through gears 95 and 96. The direction of movement and the speed of movement of the carriage 92 are controlled by the direction of rotation and the speed of rotation of the threaded bar 93.

On the other hand, as a speed control system for keeping the speed of movement of the carriage constant, use has been made of an open loop system using a pulse motor, or a closed loop system in which the driving voltage of a DC motor or the oscillation frequency of a pulse motor is controlled in confirmity with the output of the encoder 67 as shown in FIG. 12.

Also, as regards the printing system in the recording head, the wire dot system, the heat transfer system or the piezo ink jet system is the mainstream, and the response frequency of each element (dot forming element) of the recording head is 1000–3000 Hz in the wire dot system, 500–1500 Hz in the heat transfer system, and 1000–3000 Hz in the piezo ink jet system, and further, the dot density in the image output by these systems is in the range of 7 dots/mm to 14 dots/mm.

However, in the prior-art serial recording apparatus, the rotational movement of the motor for driving the carriage has been converted into rectilinear reciprocal movement through a rack and a pinion, pulleys and a belt, a wire rope or a lead screw as shown in FIGS. 12–15, respectively, and this has lead to the necessity of a mechanism portion for transmitting and converting the power. To maintain dot position accuracy in the dot density area as previously mentioned, it has become necessary to increase the frequency of the pulse motor or to make the pitch of the encoder (such as the encoder 67 of FIG. 12) fine and therefore, the carriage driving mechanism has been complicated in structure and it has been difficult to make it compact.

There has also been the problem that due to the back-lash between the elements in the mechanism portion, the back-lash of the guide portion for rectilinear guide and further the back-lash of meshing portions such as gears, the noise of the carriage during the reciprocal driving thereof becomes so great that it is difficult to make the noise low.

Also, the presence of back-lash in the mechanism portion has made it difficult to improve dot position accuracy.

In the wire dot system, the heat transfer system and the piezo ink jet system which are the conventional printing systems, it is necessary from the limitations in the recording system to keep the printing period (the driving period of the recording head) constant and therefore, design is made such that the speed of movement of the carriage to be synchronized with the printing period is also kept always constant.

The control for making the speed of the carriage constant has been executed by a method using a motor having a sufficient output torque in reserve in a case where the carriage driving motor is a pulse motor and open loop control is effected, and further has been executed also by a method of effecting speed control by a closed loop system of a DC motor or a pulse motor and an encoder.

Here, description will be made of the relation between the printing operation and the speed of movement of the carriage in the various prior-art printing systems.

FIGS. 16A to 16C of the accompanying drawings is a graph illustrating the timing of the printing operation of the wire dot system. FIG. 16A shows the repeated printing period of the print wire, FIG. 16B shows the time for which electric power is supplied to the magnet coil of each print wire of the wire dot head, and FIG. 16C shows each flight cycle until the print wire begins to move and prints and returns.

FIG. 17 of the accompanying drawings is a schematic cross-sectional view of the wire dot head.

In the case of the wire dot system, when the head response frequency is 2500 Hz approximate to the highest speed, the repeated printing period of the same print wire 52 is 400 μs {FIG. 16A} as shown in FIGS. 16 and 17, and usually the time for which electric power is supplied to the magnet coil 51 is set to the order of 200 μs {FIG. 16B}.

On the other hand, about 390 μs {FIG. 16C} is necessary as the shortest flight time from after the print wire 52 begins to move until it impacts the surface of a sheet (a recording medium such as printing paper) 53 and returns and therefore, under the condition approximate to the above-mentioned highest speed, the stable operation of the print wire 52 will be moved unless the fluctuation of the printing period is controlled to the order of 10 μs (400 μs–390 μs).

Also in the case of the piezo ink jet system, as in the case of the above-described wire dot system, the fluctuation of the speed of the carriage is limited by the time for the return of a piezo vibration plate and the return of the meniscus in the orifice, instead of the wire flight time.

Further, in the case of the heat transfer system, it is very difficult to realize a printing period of frequency 2500 Hz and comparison at the same level is difficult, but a longer time for power supply is required as compared with the aforedescribed two systems and therefore, greater stability of the carriage speed becomes necessary.

FIG. 18 of the accompanying drawings diagrammatically illustrates the control system for the carriage driving system in the prior-art serial recording apparatus.

In FIG. 18, in the control circuit (MPU) 101 of the recording apparatus, there are provided a ROM 102 storing a control program, etc. therein and a RAM 103 including a working area such as a buffer register temporarily storing various data therein, and various data from a host apparatus are sent to the control circuit 101 through an interface (I/F).

The control circuit 101 controls a recording head 105 through a head drive circuit 104 and also controls a carriage motor 108 through a motor timing control circuit 106 and a motor drive circuit 107, and further controls a sheet feed motor 110 through a sheet feed motor drive circuit 109.

On the other hand, the output signal of an encoder for detecting the position and speed of the carriage is made by a photosensor 111, is shaped into a pulse wave form by a wave form shaping circuit 112, and is transmitted to the head drive circuit 104 and the motor timing control circuit 106, whereby the synchronizing control of the scanning of the carriage and the printing operation of the head is effected.

As is apparent from the foregoing description, the carriage driving control system in the prior-art serial recording apparatus is of complicated construction.

FIG. 19 of the accompanying drawings is a fragmentary perspective view showing the construction of the carriage of a wire dot recording apparatus.

In FIG. 19, a recording sheet 121 as a recording medium such as printing paper or a plastic sheet is held in intimate contact with the surface of a platen 122 which serves also as a sheet feed roller, and a carriage 125 is movably supported by a guide shaft 123 and a guide rail 124 installed forwardly of and parallel to the platen.

A wire dot head 126 containing therein a plurality of (e.g. 64) print wires and drive means therefor, and an ink ribbon cassette 127 for supplying an ink ribbon for transfer are mounted on the carriage 125.

FIG. 20 of the accompanying drawings is a fragmentary perspective view showing the construction of the carriage of a heat transfer recording apparatus.

In FIG. 20, forwardly of a platen 132 for backing up a recording sheet 131, guide shafts 133 and 134 are installed parallel thereto, and a carriage 135 is movably supported by these guide shafts 133 and 134.

On the carriage 135, a thermal head 136 having a plurality of (e.g. 64) heat generating elements is supported for movement up and down, and an ink ribbon cassette 137 for supplying an ink ribbon for transfer between the thermal head 136 and the recording sheet 131 is further mounted.

As is apparent from FIGS. 19 and 20, in the construction of the carriage of the recording apparatus of the wire dot system or the heat transfer system, the load with which the ribbon is taken up and the load with which the recording head 126, 136 contacts with the sheet 121, 131 and the ribbon are added as the load fluctuation elements during the movement of the carriage 125, 135, and this has also led to the problem that the carriage drive motor and the driving circuit therefor become bulky and complex.

As described above, in the prior-art serial recording apparatus, even if various carriage driving methods and each printing method are combined skillfully, an attempt to execute highly minute printing at a high speed would lead to complex and bulky structure as well as to great energy of operation sound, and it has been very difficult or impossible to make the apparatus compact and light in weight and reduce the noise.

In order to solve such problems, another recording apparatus in which a recording head is carried on a carriage movable in the direction of a print column, recording is effected on a sheet by the recording head and which uses an ultrasonic motor as a motor for driving the carriage is known from Japanese Patent Application Laid-Open No. 62-77968 and Japanese Patent Application Laid-Open No. 62-77969.

In the driving of this conventional carriage using an ultrasonic motor, the construction has been simplified and the noise has been reduced, but no sufficient improvement has been made in making the apparatus compact and reducing the cost of the apparatus. In the drive system for the conventional carriage using an ultrasonic motor, the guide rail of the carriage is made into an endless annular shape and is used as the vibration plate of the ultrasonic motor and a surface wave is generated in this endless annular guide rail by two piezo motors of different phases and is used as a travelling wave to drive the carriage. The necessity of such endless annular guide rail leads to the formation of annular portions at the opposite ends of the guide rail, and such annular portions at the opposite ends have made the entire apparatus very bulky and costly. This has proved a great hindrance in instrumenting the carriage drive using an ultrasonic motor.

Also, U.S. Pat. No. 4,672,256 discloses an ultrasonic motor for linear driving, but even if this ultrasonic motor is used in a printer to drive the carriage, an endless annular vibration plate serving also as a guide rail or parallel to a guide rail is required and therefore, the entire apparatus has become very bulky and costly, and this has proved a hindrance in providing the apparatus as a product.

SUMMARY OF THE INVENTION

It is an object of the present invention to overcome the above-noted disadvantages and to provide a serial printer which will not become bulky even if an ultrasonic motor is used for carriage driving.

It is another object of the present invention to drive a carriage by an ultrasonic motor constructed between the carriage and the fixed side of a recording apparatus and detect the position and speed of movement of the carriage and control the printing time of a recording head on the basis of the detection signal.

Further objects of the present invention will become apparent from the following detailed description of some specific embodiments thereof.

DESCRIPTION OF THE PREFERRED EMBODIMENTS

Embodiments of the present invention will hereinafter be described with reference to the drawings, and a first embodiment will first be described.

Figure 1:
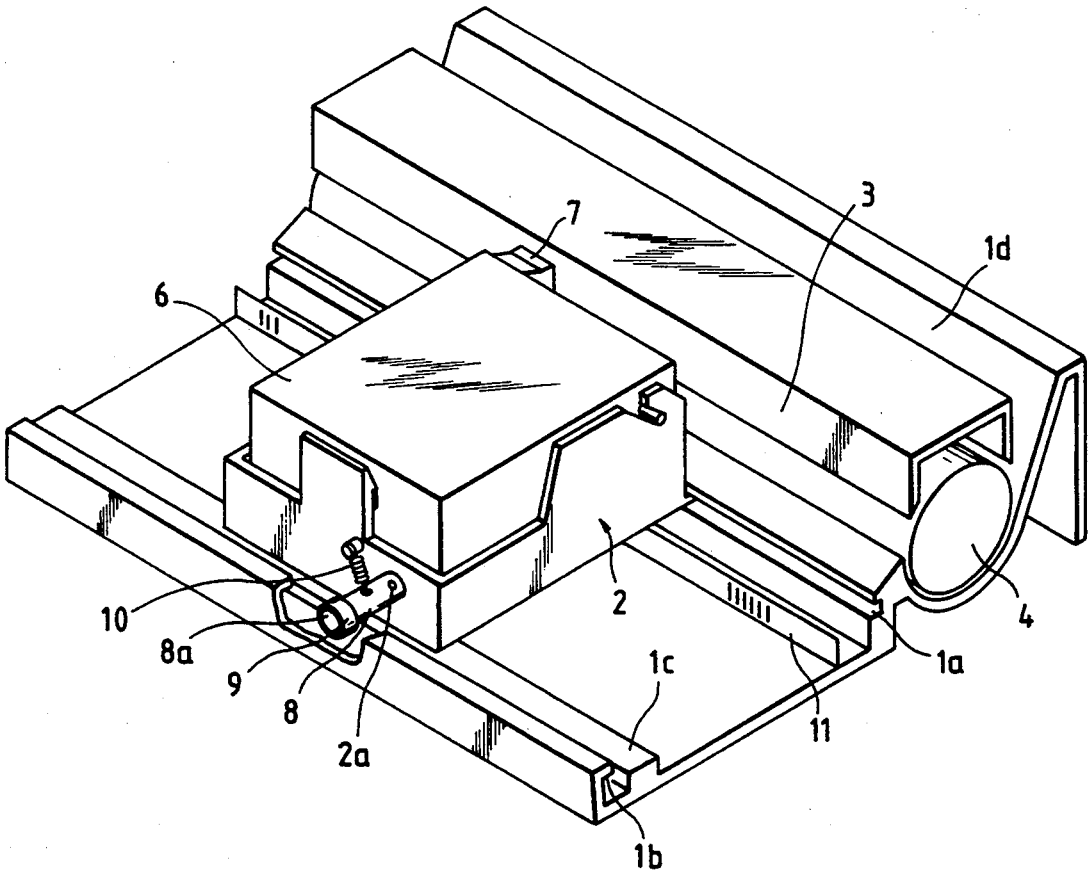
FIG. 1 is a perspective view of the essential portions of an embodiment of a serial recording apparatus according to the present invention.
Figure 2:
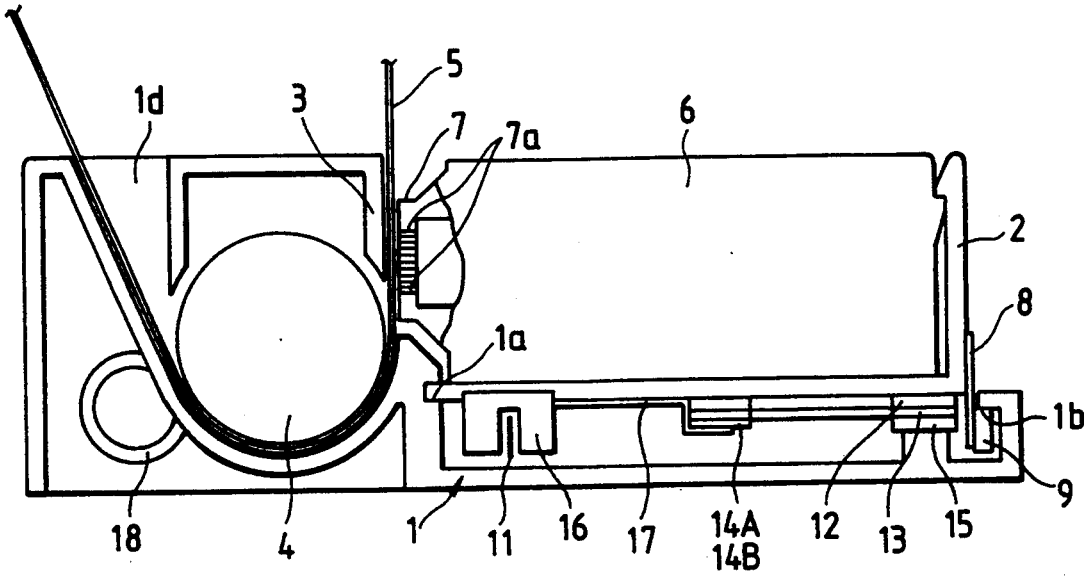
FIG. 2 is a cross-sectional view of the essential portions of FIG. 1.

Referring to FIGS. 1 and 2, the reference numeral 1 designates a base which is the standard of the structure of a recording apparatus, the reference numeral 2 denotes a carriage guided by guide portions 1*a*, 1*b* and 1*c* formed in the base 1 and sliding along the base 1, the reference numeral 3 designates a platen installed parallel to the direction of movement of the carriage 2, and the reference numeral 4 denotes a sheet feed roller for conveying a sheet (a recording medium such as recording paper) 5 inserted from an opening 1*d* in the base 1 through the front face (the printing portion) of the platen 3.

An ink cartridge 6 constituting an ink tank is removably carried on the carriage 2, and in the example shown, a recording head (ink jet head) 7 formed with a plurality of ink discharge ports (orifices) 7*a* facing the platen 3 with a predetermined interval (e.g. 0.8 mm) is provided on the front portion of the ink tank 6. This ink jet head 7 can be formed integrally with the ink tank 6, or can be provided removably (for example, in the insertable fashion) relative to the ink tank 6.

The base of an arm 8 pivotable about a pin portion 2*a* formed on the rear surface of the carriage 2 is pivotally mounted on the pin portion 2*a*, and a roller 9 is rotatably supported on a pin portion 8*a* formed at the tip end of the arm 8. This roller 9 is guided along the guide portion 1*b* (the downwardly facing surface).

The arm 8 is biased by a coil spring 10 in a direction in which the roller 9 is urged against the guide portion 1*b*. The roller 9 is thus urged against the guide portion 1*b*, whereby the carriage 2 is urged from above against the guide surfaces of the guide portions 1*a* and 1*c* by the reaction force thereof, and the carriage 2 (more specifically, including a portion of an ultrasonic motor provided integrally with the carriage 2) is supported so as to slide along the base 1 in intimate contact therewith without any backlash.

A belt-like encoder 11 having a light and shade pattern or slits (windows) at a predetermined pitch is installed on the base 1. This encoder 11 is used to detect the position and speed of movement of the carriage 2 as will be described later.

Figure 3:
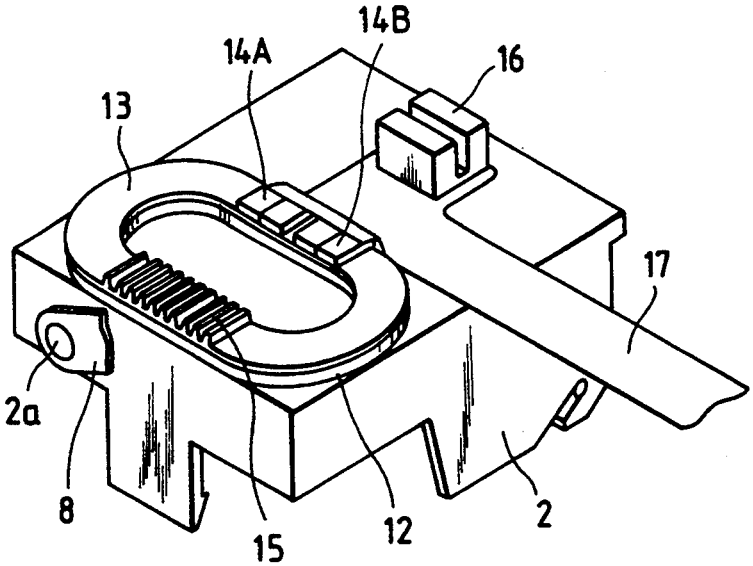
FIG. 3 is a perspective view of the bottom surface of the carriage in FIG. 1.

Referring to FIGS. 2 and 3, a vibration plate 13 is attached to the underside of the carriage 2 with a holding plate 12 interposed therebetween, and two pairs of piezoelectric elements 14A and 14B are stuck to predetermined locations on the vibration plate 13.

The holding member 12 and the vibration plate 13 each are formed of an elliptical plate having a predetermined thickness and a size substantially equal to the width of the carriage, as shown in FIG. 3, and are integrally stuck to the underside of the carriage 2 in a stacked state.

Comb-teeth 15 concave and convex at a predetermined pitch in the direction of movement of the carriage are formed on that portion of the vibration plate 13 which is urged against and slides on the guide portion 1*c* of the base 1. The aforementioned two pairs of piezoelectric elements 14A and 14B are stuck to that area of the vibration plate 13 which is opposite to the comb-teeth 15, and are disposed with a predetermined interval (e.g. $\frac{1}{4}$ of the full length $\lambda$ of each piezoelectric element) provided between the two pairs of piezoelectric elements 14A and 14B.

In FIGS. 2 and 3, a photosensor 16 for photoelectrically converting any variation in quantity of light based on the light and shade pattern or the windows (slits) of the encoder 11 is mounted on the underside of the carriage 2 at a location which embraces the encoder 11.

A flexible printed plate 17 for power supply and for signal transmission is connected to the piezoelectric elements 14A, 14B and the photosensor 16.

The reference numeral 18 in FIG. 2 designates a pinch roller for urging the sheet 5 against the sheet feed roller 4 and providing accurate feed to the sheet 5.

The plurality of ink discharge ports (orifices) *7a* are vertically arranged in the front surface of the ink jet head 7 provided on the front of the ink tank (ink cartridge) 6, i.e., that surface of the ink jet head 7 which faces the platen 3.

The vertically adjacent pitch of the ink discharge ports *7a* is about 0.04 mm–0.14 mm, i.e., of the order of 23.6 dots/mm–7.1 dots/mm, and in the embodiments described hereinafter, unless specifically specified, it is to be understood that ink discharge ports of a structure of 14–17 dots/mm are used.

Figure 4:
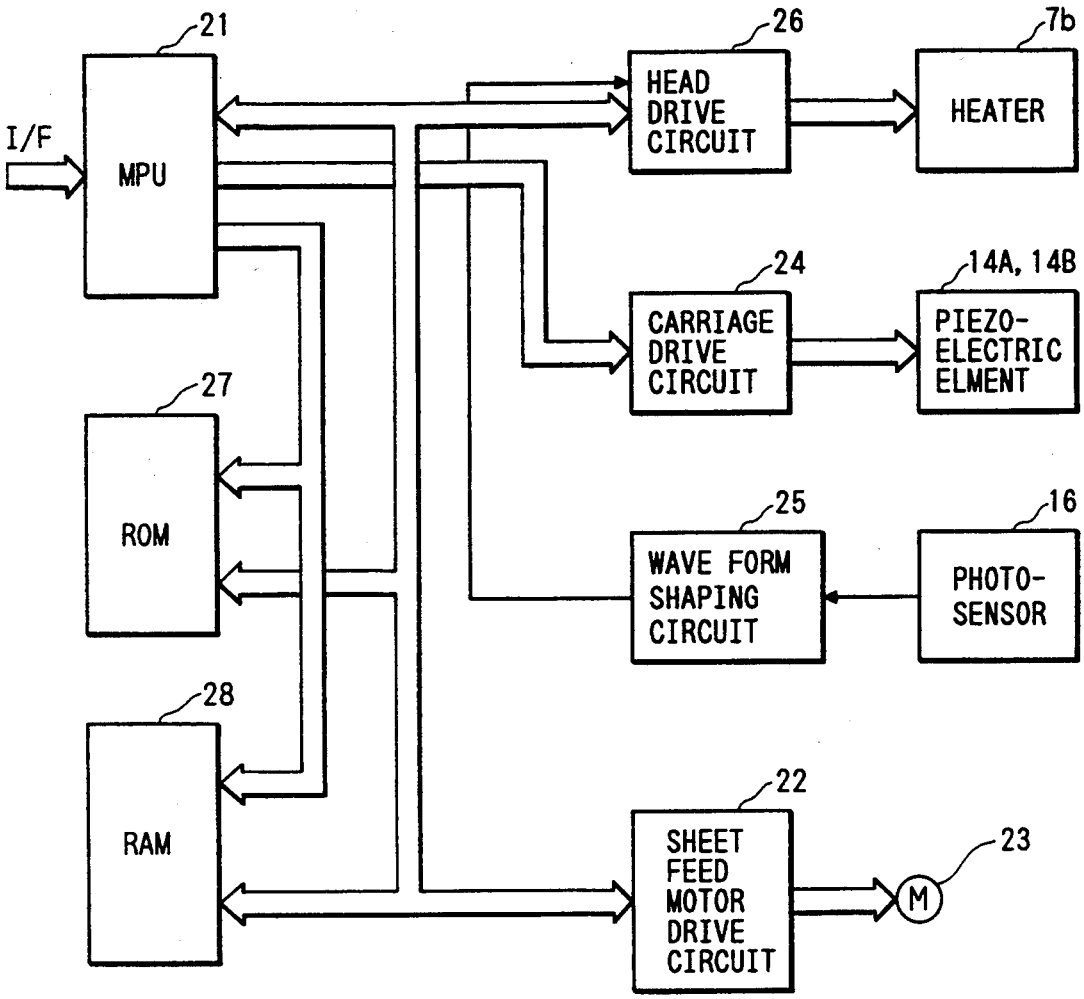
FIG. 4 is a block diagram of the control system of the recording apparatus of FIG. 1.

FIG. 4 is a block diagram of the control system of the serial recording apparatus of FIGS. 1 and 2.

In FIG. 4, a ROM 27 storing a control program, etc. therein and a RAM 28 including a working area such as a buffer register temporarily storing various data therein are provided in the control circuit (MPU) 21 of the recording apparatus, and various data from a host apparatus are sent to the control circuit 21 through an interface (I/F).

The control circuit 21 controls the ON and OFF of the heaters (printing elements) *7b* of the recording head 7 through a head drive circuit 26 and also controls the supply of electric power to the piezoelectric elements 14A and 14B through a carriage drive circuit 24.

Further, the control circuit 21 controls a sheet feed motor 23 through a sheet feed motor drive circuit 22.

On the other hand, the position and speed of the carriage 2 are detected by the photosensor 16 (FIG. 2) which cooperates with the encoder 11, and the detection signal thereof is shaped into a pulse wave form by a wave form shaping circuit 25 and is transmitted to the head drive circuit 26. Thus, the synchronizing control of the scanning of the carriage 2 and the printing operation of the head 7 is effected.

Description will hereinafter be made of the operation of the serial recording apparatus according to the present invention described with reference to FIGS. 1–4.

When the control unit (MPU) 21 receives a detection signal indicative of the presence of a sheet (the supply of a sheet) after a recording sheet (a recording medium such as printing paper or a plastic sheet) 5 has been inserted through the opening 1*d* in the base 1, the sheet feed motor 23 is driven through the sheet feed motor drive circuit 22, whereby the sheet feed roller 4 is rotated and the sheet 5 urged by the pinch roller 18 is fed to the front of the ink discharge ports *7a*.

When a printing command is then given to the control system shown in FIG. 4 from the outside through the I/F (interface), a desired high frequency current is sent to the piezoelectric elements 14A and 14B through the carriage motor drive circuit 24.

Figure 5:
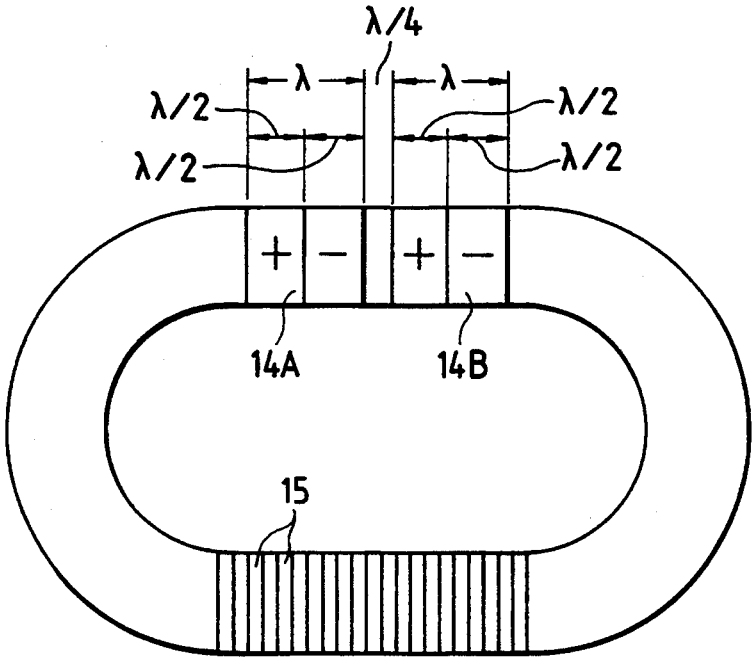
FIG. 5 is a plan view of the vibration plate and the piezoelectric element in FIG. 3.
Figure 6:
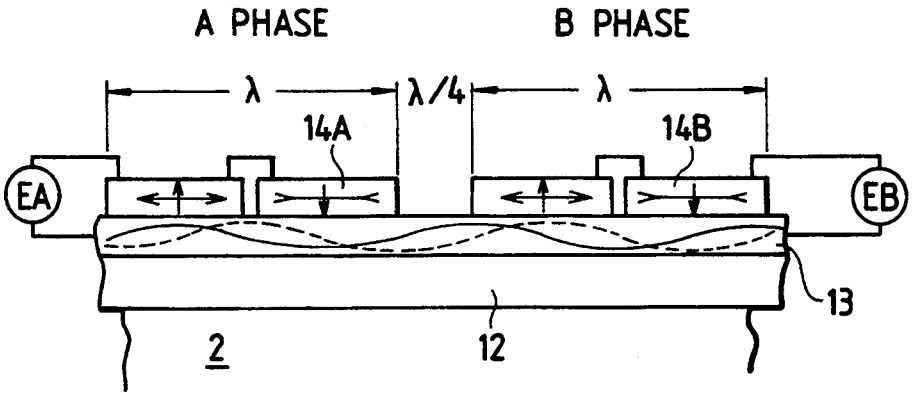
FIG. 6 is a schematic fragmentary cross-sectional view of the essential portions of FIG. 5.

FIG. 5 is a plan view of the piezoelectric element of FIG. 3, and FIG. 6 is a fragmentary longitudinal sectional view showing the principle of the creation of the drive force by the piezoelectric elements.

This piezoelectric element driving system constitutes a travelling wave type ultrasonic motor integral with the carriage 2.

As shown in FIG. 3, 5 and 6, this piezoelectric element driving system is comprised of the substantially elliptical vibration plate 13 stuck to the substantially elliptical holding member 12 and partly formed with the comb-teeth 15, two pairs of piezoelectric elements 14A and 14B fastened to that side of the vibration plate 13 which is opposite to the comb-teeth 15, and the flexible printed plate 17 for supplying electric power to the piezoelectric elements 14A and 14B.

As shown in FIGS. 5 and 6, the two pairs of piezoelectric elements 14A and 14B are fastened at an interval corresponding to ¼ of the full length λ thereof (λ/4).

The operation of the above-described piezoelectric element driving system (ultrasonic motor) will hereinafter be described.

If the two pairs of piezoelectric elements 14A and 14B are called A phase and B phase, respectively, when alternating voltages expressed by the following equations $$EA = EO \sin\omega t$$

$$EB = EO \sin(\omega t + \pi/2)$$

are applied to these A phase and B phase, the amplitudes of the standing waves created are:

| | |
|---|---|
| A phase standing wave: | ZA = ZO sink × sinωt |
| B phase standing wave: | ZB = ZO sin(KX + π/2) × sin(wt ±/π 2) |

and a travelling wave created by the combination of the A phase and the B phase is $$\text{travelling wave: } Z = ZA + ZB = ZO \cos(\omega t \pm KX),$$

where $K = 2\pi/\lambda$(wave number), and $\omega = 2\pi f$ (angular speed).

Accordingly, by the travelling wave thus created, a thrust in the opposite direction to the travelling wave acts on the surface of contact between the comb-teeth 15 of the vibration plate 13 and the guide surface 1*c* of the base 1.

The speed of movement V of the carriage 2 by this thrust is $$V = 4\pi \cdot \pi \cdot f \cdot Z \cdot e/\lambda,$$

where Z = amplitude of the travelling wave, and e = ½ of the thickness of the vibration plate.

As the values in the present embodiment, f = 40 KHz, Z = 1μ, e = 1.5 mm and λ = 10 mm and therefore, the speed of movement V of the carriage 2 is of the order of $$V = 236.6 \text{ mm/s} \approx 240 \text{ mm/s}.$$

Here, the value 40 KHz of the driving frequency f of the ultrasonic motor is a very high frequency as compared with the driving frequency 2–4 KHz of the conventional motor such as a stepping motor, and the use of the ultrasonic motor makes it possible to control the movement of the carriage 2 highly accurately.

FIGS. 7A to 7E show the output wave forms made by the control system of FIG. 4 on the basis of the signal from the encoder 11 when the carriage 2 is moved at a uniform speed, and the pulses supplied to the piezoelectric elements 14A and 14B.

Figure 7A:
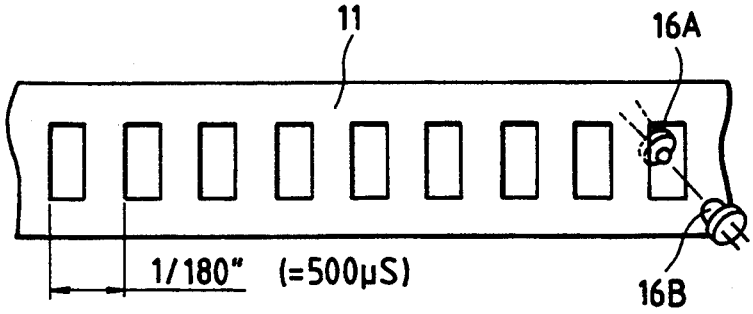
FIG. 7A is a view showing the encoder of the recording apparatus of FIG. 1 and FIGS. 7B to 7E are graphs showing the output wave form thereof and an ultrasonic motor driving pulse.

FIG. 7A is a schematic view showing the arrangement of photosensors 16 each comprising a light-emitting portion 16A and a light-receiving portion 16B with the encoder 11 formed with openings (slits) at a predetermined pitch being interposed therebetween.

Figure 7B:
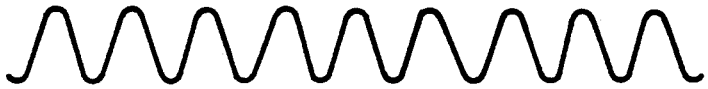

When electric power is supplied to the piezoelectric elements 14A and 14B to drive the carriage 2 and the carriage 2 reaches a uniform speed range, an analog output as shown in FIG. 7B is produced by the photosensors 16A, 16B of FIG. 7A.

Figure 7C:
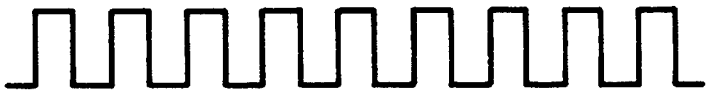
Figure 7D:
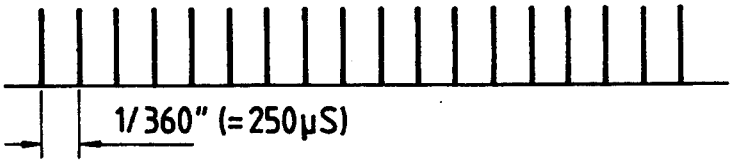

This analog output is shaped into a pulse wave form as shown in FIG. 7C by the wave form shaping circuit 25 of the control system of FIG. 4, whereafter there is created a head driving pulse (dot pitch control pulse) of a predetermined period (in the shown example, 250 μs) as shown in FIG. 7D.

The horizontal axis of FIGS. 7A–7E is a common axis representative of time or the carriage position.

Figure 7E:
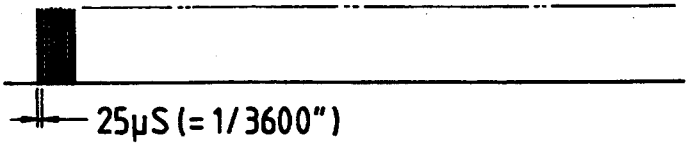

FIG. 7E shows the ultrasonic motor driving pulse wave form of power supply period 25 μs applied to the piezoelectric elements 14A and 14B.

Figure 8A:
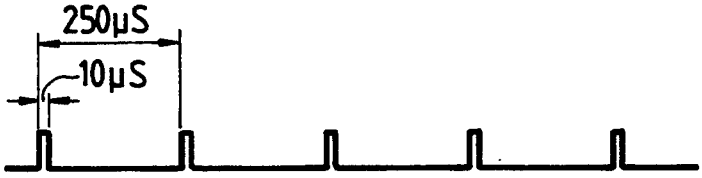
FIGS. 8A to 8C are timing charts showing the driven state of the thermal ink jet head of FIG. 1.
Figure 8B:
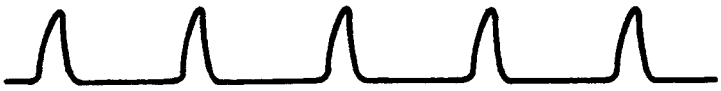
Figure 8C:
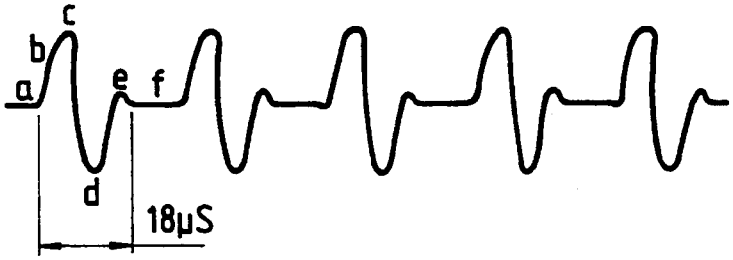

FIGS. 8A to 8C are timing charts showing the driven state of the ink jet head 7. FIG. 8A shows the driving signal of the ink jet head 7, i.e., the power supply pulse width and the power supply period, FIG. 8B shows a heat current wave form flowing to the heater 7*b* of the thermal type ink jet head 7 which will be described later, and FIG. 8C shows variations in the amount of protrusion and the amount of retraction of the meniscus (including the formation process of liquid droplet 7*d*) 7*c* in the ink discharge port of the thermal ink jet head 7 shown in FIG. 9.

Figure 9A:
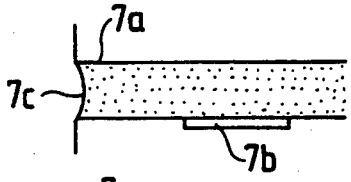
FIGS. 9A to 9F are schematic longitudinal sectional views showing the ink discharge process of the thermal ink jet head of FIG. 1.
Figure 9B:
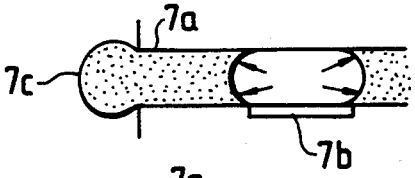

The reference characters a, b, . . . , f in FIG. 8C indicate meniscus positions corresponding to the states of FIGS. 9A, 9B . . . 9F.

FIGS. 9A to 9F are longitudinal sectional views showing the ink droplet formation process near the ink discharge port (orifice) 7*a* of the thermal ink head 7.

In FIGS. 9A to 9F, the reference character 7*a* designates the ink discharge port, the reference character 7*b* denotes a heater comprising a heat generating element, the reference character 7*c* designates the liquid surface tip end (meniscus) of ink near the ink discharge port, and the reference character 7*d* denotes an ink droplet.

Figure 9C:
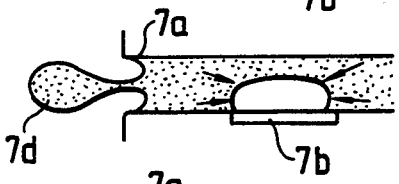
Figure 9D:
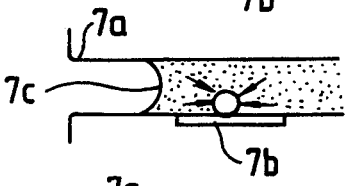
Figure 9E:
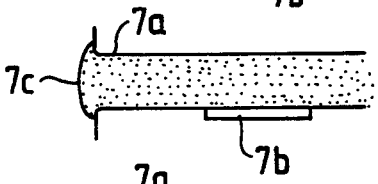
Figure 9F:
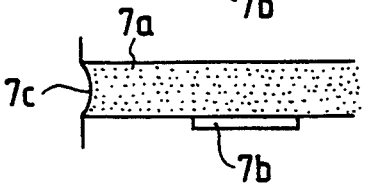

FIG. 9A shows the standby state, FIG. 9B shows a state in which bubbling has begun in the ink during the power supply to the heater 7*b*, FIG. 9C shows a state in which the power supply to the heater 7*b* has been stopped and de-bubbling has begun and the ink droplet 7*d* is about to fly, FIG. 9D shows a state in which the ink droplet 7*d* has departed and the liquid surface tip end (meniscus) 7*c* has retracted greatly, FIG. 9E shows a state in which due to the reaction of the retraction of the meniscus in FIG. 9D, the meniscus 7*c* has swollen from the ink discharge port surface, and FIG. 9F shows a state in which the same standby state as FIG. 9F has been restored.

As illustrated in FIGS. 8A to 9F, according to the thermal ink jet system in which each ink discharge port is driven by the heater 7*b*, as compared with other recording systems, a very short power supply time (10 μs) and excellent responsiveness (the ink droplet discharging operation time is 180 μs) can be achieved.

Therefore, even if the speed of movement of the carriage 2 fluctuates by the order of ±10% and the power supply period varies between 225 μs to 275 μs, the stability of ink discharge is maintained and thus, the carriage motor drive circuit 24 and the head drive circuit 26 are operable by completely discrete systems, and the drive circuit could be simplified.

According to the embodiment described above, the ultrasonic motor using the piezoelectric elements 14A and 14B is used as the drive source of the carriage 2 and therefore, the mechanism for power transmission and conversion could be eliminated and a carriage driving system capable of being simplified in structure and being made compact could be realized.

Also, the absence of the mechanism for transmitting and converting the power could result in the realization of a quiet recording apparatus in which the noise level during operation could be greatly reduced.

At the same time, the responsiveness during operation could be enhanced (quickened).

Further, by using the driving system of the piezoelectric elements 14A and 14B, the self-holding force works in the stopped state of the carriage 2 and therefore, any special mechanism for holding the carriage 2 is not required, and the absence of a winding portion leads to a very low level of the magnetic noise resulting from the flowing of electric current and therefore, any countermeasure for the magnetism emission noise as the apparatus (such as the printed plate structure or a magnetic shield sheath) is not required and accordingly, a serial recording apparatus which is simple in structure and can achieve a reduction in cost can be provided.

Figure 10:
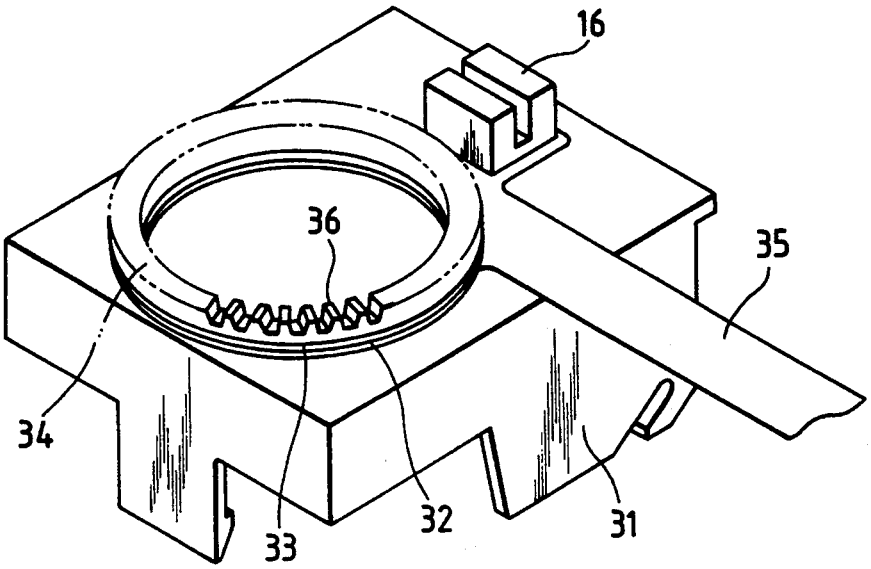
FIG. 10 is a perspective view of the bottom surface of a carriage in another embodiment of the serial recording apparatus according to the present invention.
Figure 11:
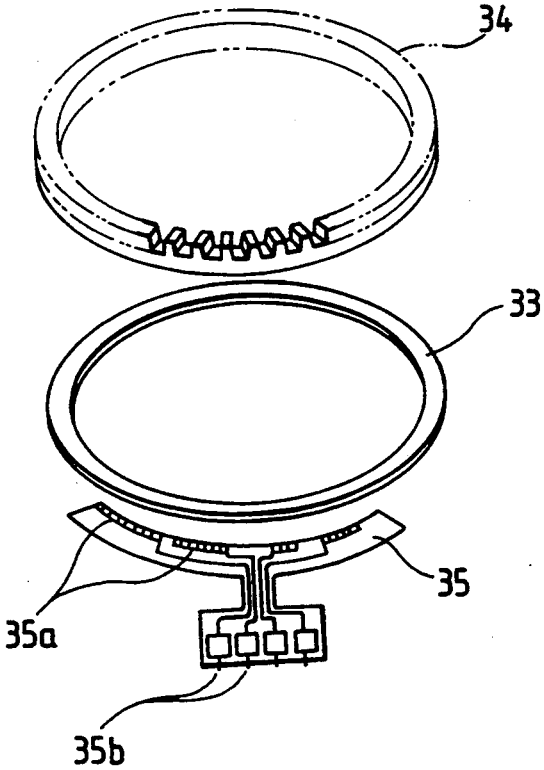
FIG. 11 is an exploded perspective view of the ultrasonic motor portion of FIG. 10.
Figure 12:
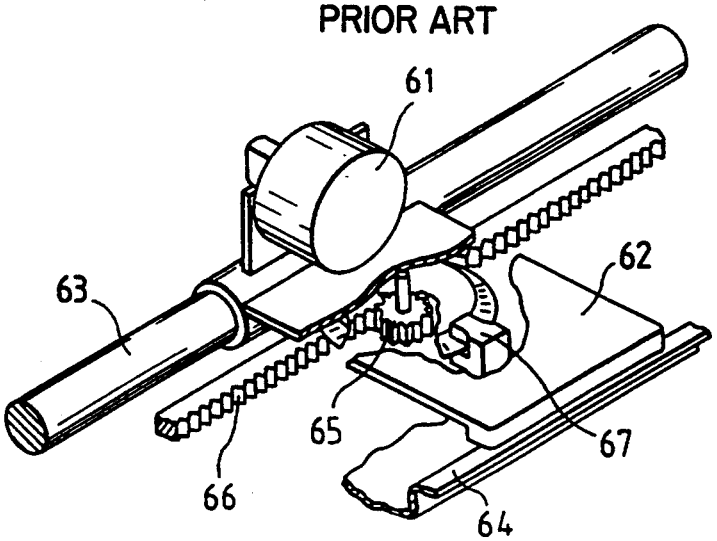
FIG. 12 PRIOR ART
FIG. 12 is a perspective view showing a carriage driving mechanism of the conventional rack-and-pinion type.
Figure 13:
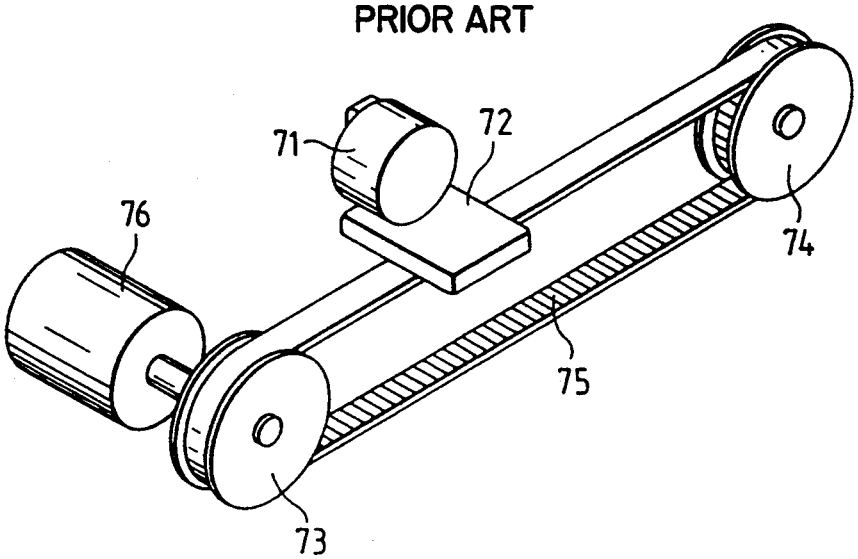
FIG. 13 PRIOR ART
FIG. 13 is a perspective view showing a carriage driving mechanism of the conventional belt transmission type.
Figure 14:
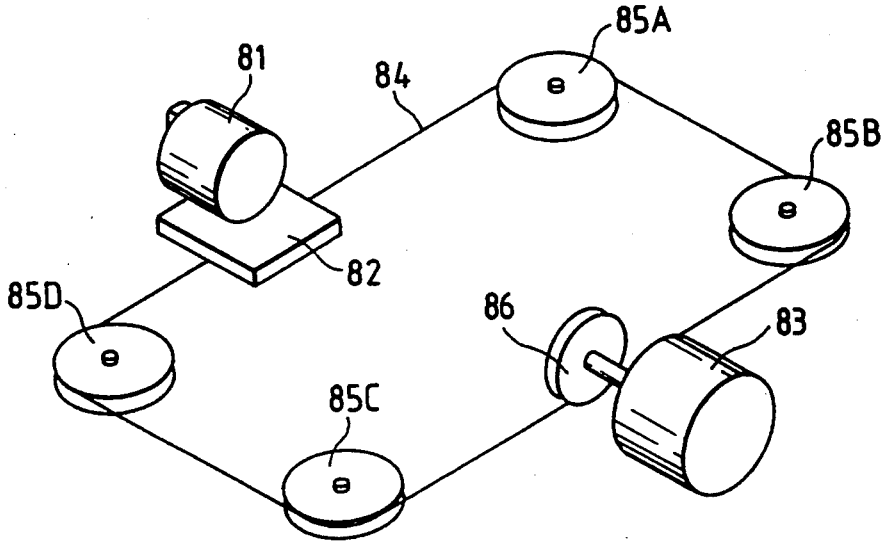
FIG. 14 PRIOR ART
FIG. 14 is a perspective view showing a carriage driving mechanism of the conventional wire rope transmission type.
Figure 15:
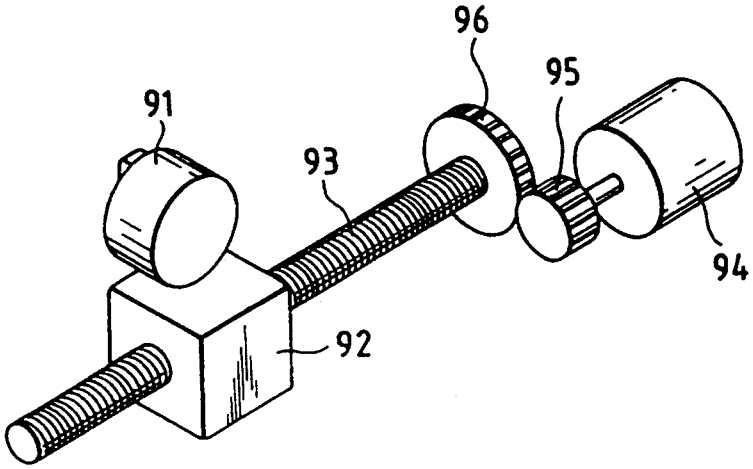
FIG. 15 PRIOR ART
FIG. 15 is a perspective view showing a carriage driving mechanism of the conventional lead screw type.
Figure 16A:
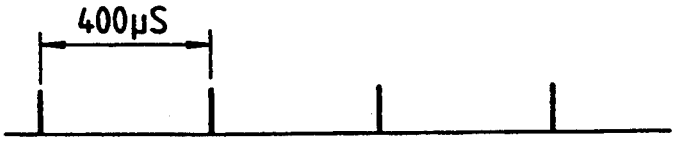
FIG. 16A PRIOR ART
FIGS. 16A to 16C are graphs showing the driving pulse wave form of a wire dot head.
Figure 16B:
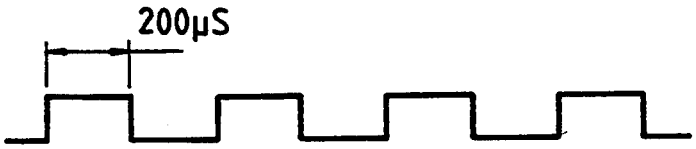
FIG. 16B PRIOR ART
Figure 16C:
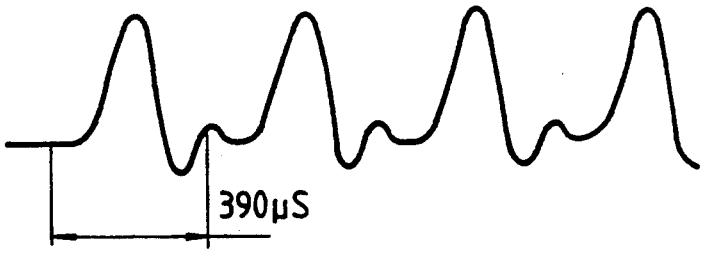
FIG. 16C PRIOR ART
Figure 17:
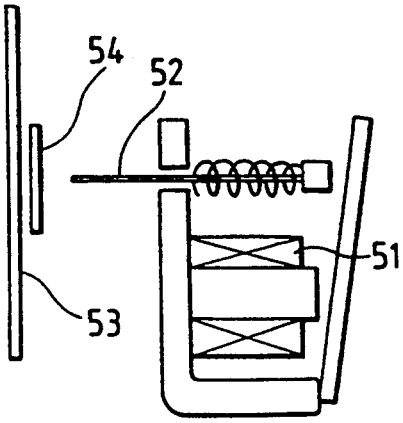
FIG. 17 PRIOR ART
FIG. 17 is a schematic cross-sectional view of the wire dot head.
Figure 18:
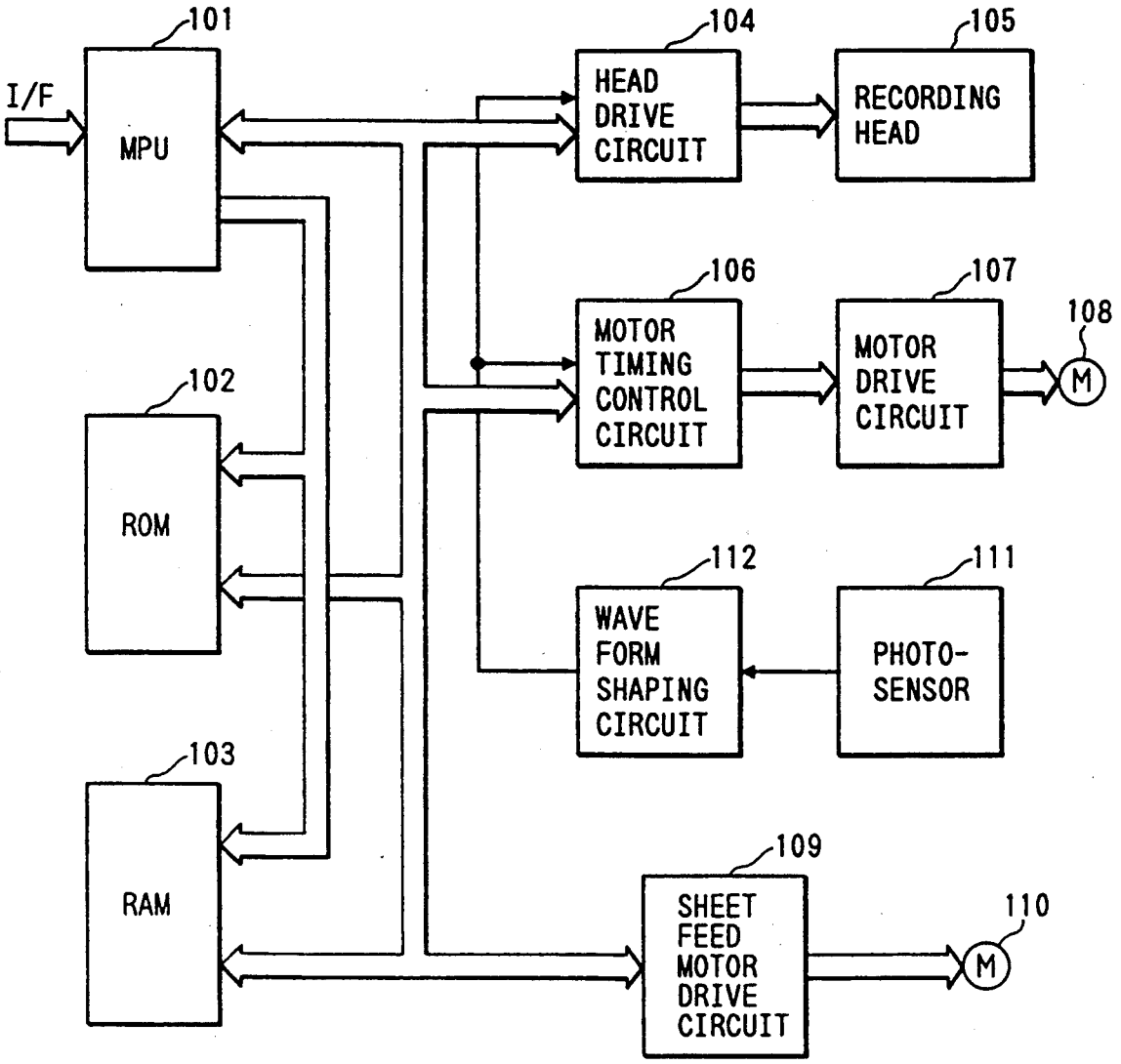
FIG. 18 PRIOR ART
FIG. 18 is a block diagram of the control system of a prior-art serial recording apparatus.
Figure 19:
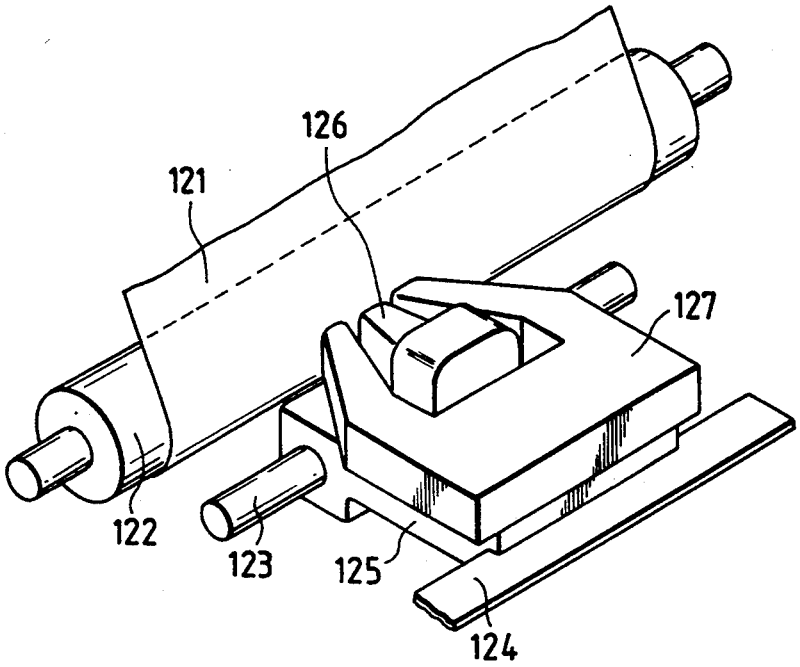
FIG. 19 is a perspective view of the essential portions of a wire dot type recording apparatus.
Figure 20:
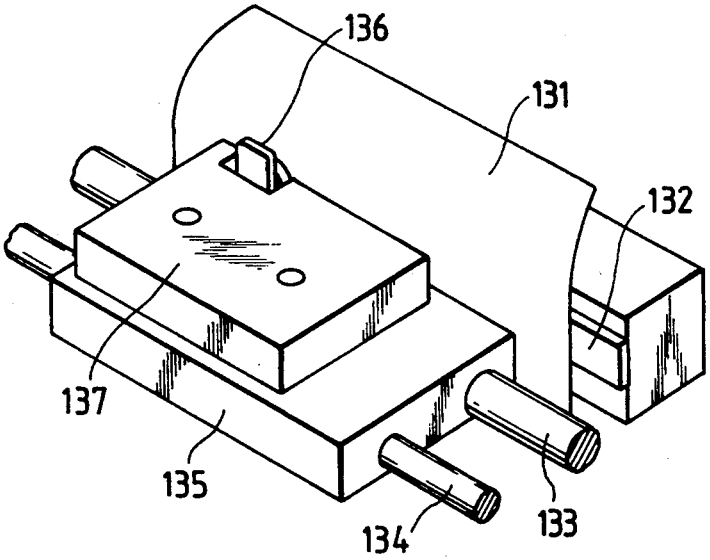
FIG. 20 is a perspective view of the essential portions of a heat transfer type recording apparatus.

FIG. 10 is a perspective view of the carriage cartridge of a serial recording apparatus according to another embodiment of the present invention as it is inverted and seen from the underside thereof, and FIG. 11 is an exploded perspective view of the carriage-mounted parts in FIG. 10.

In FIG. 10, a piezoelectric element 33 and a vibration plate 34 are secured to the underside of a carriage 31 in a laminated state with a holding plate 32 interposed therebetween.

Also, as in the case of FIG. 3, a photosensor 16 and a flexible printed substrate 35 are mounted on the underside of the carriage 31, and the supply of electric power to the piezoelectric element 33 and the taking-out of the signal from the photosensor 16 are effected through the flexible printed substrate 35.

In FIG. 11, an electrode portion 35*a* electrically connected to the piezoelectric element 33 and the photosensor 16 and a connector 35*b* for connection to the control circuit 21 of the recording apparatus or to a circuit substrate taken out of the control circuit 21 are provided on the flexible printed substrate 35.

The holding plate 32, the piezoelectric element 33 and the vibration plate 34 are all of a circular ring shape as shown in FIGS. 10 and 11, and comb-teeth 36 are formed on the surface of the vibration plate 34.

A rotor (not shown) constituting an ultrasonic motor is rotatably supported on a shaft (not shown) concentric with the vibration plate 34 and provided on the underside of the carriage 31, and in the assembled state, one surface of the rotor is in contact with the vibration plate 34 and the other surface of the rotor is in contact with the guide surface 1*c* of the base 1 shown in FIG. 1.

To construct the ultrasonic motor, instead of using the rotor, the vibration plate 34 may be brought into direct contact (pressure contact) with the guide surface 1c of the base 1.

The other portions of the embodiment of FIGS. 10 and 11 are substantially the same as those of the embodiment described with reference to FIGS. 1–8.

According to the embodiment described above with reference to FIGS. 10 and 11, the same effect as that of the embodiment described with reference to FIG. 1–9 has been obtained and in addition, since the shapes of the parts are similar circular shapes, the manufacture of the ultrasonic motor (the piezoelectric element driving system) and the carriage 31 has become easy and moreover, the effect that the thrust produced by the vibration plate 34 can be efficiently converted into a rectilinear force could be obtained by interposing the rotor.

As described above, according to the serial recording apparatus of the present invention, an ultrasonic motor comprising the piezoelectric elements 14A, 14B, 33 and the vibration plate 13, 34 is used for carriage driving and therefore, it has become possible to construct a serial recording apparatus which can be simplified in structure and can be made compact and light in weight and in which the noise level during the operation can be greatly reduced and which has a self-holding force in the stopped state of the carriage and in which the magnetic noise during the driving of the piezoelectric elements is very small, and the stabilization of the quality of print, the high reliability and the reduction in the cost in the recording apparatus could be achieved.

As is apparent from the foregoing description, according to the present invention, in a serial recording apparatus wherein a recording head is carried on a carriage movable in the direction of the print column and recording is effected on a sheet by the recording head, a vibration plate driven by piezoelectric elements is provided on the underside of the carriage and use is made of a travelling wave type ultrasonic motor which enables the vibration plate to slide on a guide member on the base side and therefore, a construction which can make the apparatus compact to reduce the cost thereof and which can make the apparatus ready for production has been realized. Also, design is made such that the position and speed of movement of the carriage are detected and the printing period of the recording head is controlled on the basis of the detection signal and therefore, there can be provided a highly accurate serial recording apparatus in which even when the speed of the carriage changes, the position and printing timing of the carriage can be controlled highly accurately to thereby ensure a stable quality of print free of dot deviation.

What is claimed is:

1. A serial recording apparatus including:

a carriage movable in a direction transverse to print columns, the carriage carrying thereon a thermal ink jet head driven by printing drive signals;

a guide member for guiding the movement of said carriage in the direction transverse to print columns;

detecting means for detecting movement of the carriage, the detecting means producing a pulse signal for each predetermined amount of movement of said carriage;

an endless annular shaped vibration plate provided on said carriage, said vibration plate having a portion of contact with said guide member and having an electro-mechanical conversion element which is driven by high frequency drive pulses and generates a travelling wave which acts on said guide member through said portion of contact to thereby move said carriage in the direction transverse to print columns, and control means for generating the high frequency drive pulses for driving said electro-mechanical conversion element and printing drive signals for said thermal ink jet head, wherein a time period during which one of the printing drive signals is generated is smaller than a time interval between any two of the high frequency drive pulses, and the control means controls printing time of said thermal ink jet head in accordance with the carriage movement pulse signal from said detecting means to synchronize the movement of said carriage with a printing operation of said thermal ink jet head.

2. A serial recording apparatus according to claim 1, wherein said vibration plate is formed to a predetermined thickness and fixed to the underside of said carriage with a holding plate interposed therebetween.

3. A serial recording apparatus according to claim 1, wherein the portion of contact of said vibration plate is formed with comb-teeth concave and convex at a predetermined pitch in the direction of print column.

4. A serial recording apparatus according to claim 3, wherein said electro-mechanical conversion element is provided on the area opposite to the comb-teeth of said vibration plate.

5. A serial recording apparatus according to claim 4, wherein said electro-mechanical conversion element is a plurality of pairs of piezoelectric elements arranged at a predetermined interval.

6. A serial recording apparatus according to claim 1, wherein said detecting means has an encoder and a photosensor cooperating with said encoder and mounted on said carriage.

7. A serial recording apparatus including:

an apparatus body having a base;

a carriage movable in a direction transverse to print columns, the carriage carrying thereon a thermal ink jet head driven by printing drive signals;

a first guide member for guiding the movement of said carriage in the direction transverse to print columns, a guide roller provided on said carriage, said guide roller being rotatable along said first guide member, a second guide member for guiding the movement of said carriage in the direction transverse to print columns, the second guide member being provided on said base of said apparatus body;

detecting means for detecting a movement of the carriage, said detecting means producing a pulse signal for each predetermined amount of movement of said carriage;

an elliptical vibration plate provided on said carriage, said vibration plate having a portion of contact with said second guide member and having an electro-mechanical conversion element which is driven by high frequency drive pulses to generate a travelling wave which is caused to act on said second guide member by said portion of contact to thereby move said carriage in the direction transverse to print columns; and control means for generating the high frequency drive pulse for driving said electro-mechanical conversion element and the printing drive signal for driving said thermal ink jet head, wherein a time period during which one of the printing drive signals is generated is smaller than a time interval between any two of the high frequency drive pulses and the control means controls printing time of said thermal ink jet head in accordance with the pulse signal from said detecting means to synchronize the movement of said carriage with a printing operation of said thermal ink jet head.

8. A serial recording apparatus according to claim 7, further including a biasing member for biasing said guide roller in a direction to be urged against said first guide member, said biasing member urging said portion of contact against said second guide member by the reaction force of biasing.

9. A serial recording apparatus including:

an apparatus body having a base;

a carriage movable in a direction transverse to print columns, the carriage carrying thereon a thermal ink jet head driven by printing drive signals;

a guide member for guiding the movement of said carriage in the direction transverse to print columns, the guide member being provided on said base of said apparatus body;

detecting means for detecting a movement of the carriage, the detecting means producing a pulse signal for each predetermined amount of movement of said carriage;

an elliptical holding member provided on said carriage;

an elliptical vibration plate mounted on said holding member, said vibration plate having a comb-tooth portion contacting said guide member along the direction transverse to print columns;

an electro-mechanical conversion element provided on an area of said vibration plate opposite the comb-tooth portion of said vibration plate, said electro-mechanical conversion element being driven by high frequency drive pulses to generate a travelling wave which acts on said guide member through said comb-tooth portion to thereby move said carriage in the direction transverse to print columns; and control means for generating the high frequency drive pulses for driving said electro-mechanical conversion element and the printing drive signals for said thermal ink jet head, wherein a time period during which one of the printing drive signals is generated is smaller than a time interval between any two of the high frequency drive pulses and control means controls printing time of said thermal ink jet head in accordance with the pulse signal from said detecting means to synchronize the movement of said carriage with a printing operation of said thermal ink jet head.

10. A serial recording apparatus including:

an apparatus body having a base;

a carriage movable in a direction transverse to print columns, the carriage carrying thereon a thermal ink jet head driven by printing drive signals;

a guide member for guiding the movement of said carriage in the direction transverse to print columns, the guide member being provided on said base of said apparatus body;

detecting means for detecting a movement of the carriage, the detecting means producing a pulse signal for each predetermined amount of movement of said carriage;

an endless annular shaped vibration plate provided on said carriage, said vibration plate having a portion of contact with said guide member and having an electro-mechanical conversion element which is driven by high frequency drive pulses to generate a travelling wave which is caused to act on said guide member through said portion of contact to thereby move said carriage in the direction transverse to print columns; and control means for generating the high frequency drive pulses for driving said electro-mechanical conversion element and the printing drive signals for driving said thermal ink jet head, wherein a time period during which one of the printing drive signals is generated is smaller than a time interval between any two of the high frequency drive pulses and the control means controls printing time of said thermal ink jet head in accordance with the pulse signal from said detecting means to synchronize the movement of said carriage with a printing operation of said thermal ink jet head.

* * * * *